United States Patent [19]

Brännström

[11] Patent Number: 4,606,739

[45] Date of Patent: Aug. 19, 1986

[54] METHOD OF INCREASING THE SEPARATING EFFICIENCY OF A CYCLONE SEPARATOR AND A CYCLONE FOR CARRYING OUT THE METHOD

[75] Inventor: Roine Brännström, Finspong, Sweden

[73] Assignee: ASEA Stal AB, Västerås, Sweden

[21] Appl. No.: 640,261

[22] Filed: Aug. 13, 1984

[30] Foreign Application Priority Data

Aug. 16, 1983 [SE] Sweden ..... 8304429

[51] Int. Cl.[4] ..... B04C 5/02; B04C 5/00

[52] U.S. Cl. ..... 55/1; 55/418; 55/435; 55/459 R; 55/465; 209/143; 209/144; 210/512.1

[58] Field of Search ..... 55/1, 418, 435, 461, 55/459 R, 462, 459 D, 337, 342, 465, 315; 209/211, 144, 143, 3; 210/512.1, 512.2

[56] References Cited

U.S. PATENT DOCUMENTS

| | | | |
|---|---|---|---|
| 1,469,702 | 9/1923 | Spencer | 55/342 |
| 2,056,022 | 9/1936 | Steenstrup . | |
| 2,311,868 | 2/1943 | Rhoads . | |
| 2,718,754 | 9/1955 | Lewis et al. . | |
| 3,146,998 | 9/1964 | Golucke et al. | 55/459 R X |
| 3,974,572 | 8/1976 | Cerles et al. . | |
| 4,267,048 | 5/1981 | Ohishi | 210/512.2 |
| 4,288,235 | 9/1981 | Gartside et al. | 55/435 X |
| 4,504,291 | 3/1985 | Haddad et al. | 55/465 |

FOREIGN PATENT DOCUMENTS

| | | | |
|---|---|---|---|
| 140507 | 9/1979 | Denmark . | |
| 82057480 | 6/1984 | Sweden . | |
| 1484425 | 9/1977 | United Kingdom . | |
| 2080138A | 2/1982 | United Kingdom . | |
| 761539 | 9/1980 | U.S.S.R. | 210/512.2 |

*Primary Examiner*—S. Leon Bashore
*Assistant Examiner*—Thomas M. Lithgow
*Attorney, Agent, or Firm*—Pollock, Vande Sande & Priddy

[57] ABSTRACT

The separating efficiency of a cyclone separator used for removing solid particles from a gas stream (for example ash particles from the combustion gas which is passed to a gas turbine) is increased by retarding the particles before they arrive at the cyclone and thereafter accelerating them over a short distance before they enter the cyclone. In this way large particles will have a lower speed than small particles when entering the cyclone. Despite a high velocity of the transport gas and a high inlet velocity for small particles, it is possible to obtain an inlet velocity for larger particles which is desirably low from the point of view of reducing erosion of the cyclone separator. The separation of fine particles is improved. The retardation of the particles may take place in a T-shaped branch pipe, which has one branch connected to the cyclone, a second branch connected to a conveying pipe and a third branch which is formed as a blind space.

20 Claims, 4 Drawing Figures

METHOD OF INCREASING THE SEPARATING EFFICIENCY OF A CYCLONE SEPARATOR AND A CYCLONE FOR CARRYING OUT THE METHOD

BACKGROUND OF THE INVENTION

The invention relates to a method of increasing the separating efficiency in a cyclone separator and to a cyclone separator for separating particles having varying size.

The separating efficiency of a cyclone is highly dependent on the inlet velocity of the particles entering the cyclone and on the particle size of the particles. An increased inlet velocity gives a higher separating efficiency. Small particles are more difficult to separate than large particles. This is due to the fact that small particles have a low falling velocity and are drawn more easily with the gas stream into the vortex in the central part of the cyclone separator.

To increase the separating efficiency, the most obvious thing to do would be to increase the inlet velocity of the particles entering the cyclone. However in a plant of conventional design this results in:

1. the pressure drop increasing, and
2. the erosion rate of the envelope surface of the cyclone increasing. The erosion is caused mainly by the larger particles.

A pressure drop increase can often be accepted, but an increased erosion rate with increasing entry speed leads to a drastic reduction of the life of the cyclone which is unacceptable for commercial reasons. To keep the erosion rate to an acceptable level, a maximum inlet velocity of about 20–30 m/s is normally used.

OBJECT OF THE INVENTION

The object of the invention is to increase the separating efficiency, in a plant with a cyclone separator, without the above-mentioned negative effects associated with increased gas transport velocity at the inlet of the cyclone.

SUMMARY OF THE INVENTION

According to the invention, the improvement is brought about by the particles in the transport gas flow being slowed down, suitably to a standstill, at some distance upstream from the cyclone inlet. After the retardation, the particles are accelerated by the transport gas flow. The large heavy particles are accelerated more slowly than the small, light particles. By locating the retardation region at an appropriate distance from the cyclone inlet, a desired "velocity profile" for the particles at the inlet may be obtained. What constitutes an appropriate distance depends on a number of different factors but is chosen so that the particles exceeding a certain size and having the greatest erosion effect will have a velocity which does not exceed about 20 m/s. The smallest particles are accelerated rapidly, and preferably this will be to almost the same velocity as that of the transport gas. The high entry velocity of the smaller particles results in an improved separating efficiency for those particles while substantially the same separating efficiency is obtained for the large particles as would be obtained in a conventional cleaning plant. The total separating efficiency is thus improved by the method of the invention without any increase in erosion with the resultant reduced life of the cyclone that that produces.

The retardation of the particles may take place in a T-shaped branch pipe, where the stem of the T is connected to the cyclone inlet, a second branch is connected to a conveying pipe and the third branch is blanked off and forms a blind space. In this blind space a "cushion" of particles accumulates which forms a pad and prevents direct contact of the particles with the wall of the branch pipe in the blanked-off part and thus prevents erosion of the T-shaped pipe.

The invention may, for example, be applied to a pressurized fluidized bed combustion plant (a PFBC plant) and gas turbines which are driven with the combustion gases from such a plant. In such plants it is most important to remove the particles accompanying the combustion gases to prevent erosion damage in the gas turbines. When applying the method of the invention to known situations either the number of cleaning stages disposed in series may be maintained and a higher separating efficiency achieved, or the number of cleaning stages disposed in series may be reduced while maintaining at least the same degree of gas purification. In the latter case not only will a smaller amount of cyclones be required but a smaller space for such cyclones will be needed, thus reducing the size of the plant. The pressure vessel of the plant may also be able to be made smaller. The installation cost will also be considerably reduced. The pressure drop caused by the deflection of the gas flow in the T-branches can, in practice, be compensated for by the smaller number of cyclones required in series.

BRIEF DESCRIPTION OF THE DRAWING

The invention will be described in greater detail, by way of example, with reference to the accompanying drawing, in which.

DESCRIPTION OF PRIOR ART

Figure 1:
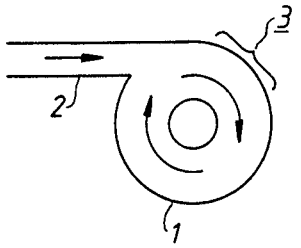
FIG. 1 is a schematic horizontal sectional view from above of a conventional design of cyclone separator.

In the drawing, the numeral 1 designates a cyclone separator which is supplied with gas, mixed with particles, through a conduit 2. The particles, for example dust accompanying the combustion gases leaving a pressurized fluidized bed in a power plant, have approximately the same velocity in the conveying pipe 2 as the transport gas. In the prior art arrangement shown in FIG. 1, the conveying pipe 2 opens out tangentially directly into the cyclone separator 1, gas and particles will then have the same velocity when entering the separator 1.

In case of a high inlet velocity, particularly coarse particles will cause strong erosion within the portion of the cyclone wall marked 3. For practical reasons, to give an acceptable working life, the upper limit for the inlet velocity of the particles entering the separator normally lies between 15 and 20 m/s. At this inlet velocity, the separation is unsatisfactory for the smallest particles.

DESCRIPTION OF PREFERRED EMBODIMENT

Figure 2:
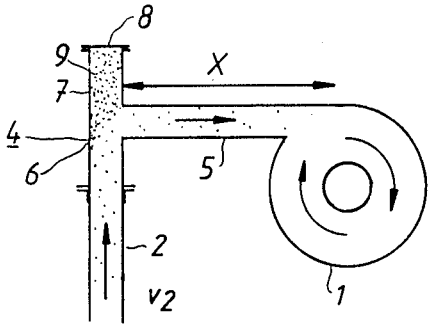
PRIOR ART FIG. 2
FIG. 2 shows a corresponding section through a cyclone in which the method of the invention is being applied.

In the embodiment of a cleaning plant according to the invention shown in FIG. 2, a T-shaped branch pipe 4 has its stem part 5 connected to the inlet of the cyclone separator 1 and the conveying pipe 2 is connected to the part 6 of the branch pipe. The part 7 of the branch pipe is sealed off by a plate 8 and forms a blind space 9 which will be filled with particles which form a "brake cushion" or pad against which the particles in the conveying pipe are slowed down. After having slowed down, the particles are accelerated as they travel along the branch 5 of the branch pipe. Small particles are accelerated rapidly, large particles more slowly. By selecting a suitable length x of the branch pipe part 5 in relation to the particle load, the particle size distribution, the particle density, the pressure, temperature, viscosity etc. of the transport gas, a suitable "velocity profile" of the particle mass in the gas flow can be achieved. It will be possible to use gas speeds of 50 m/s or thereabove and still obtain a velocity of the larger particles which is lower than 15–20 m/s, and this is desirable from the point of view of reducing wall erosion of the separator.

Figure 3:
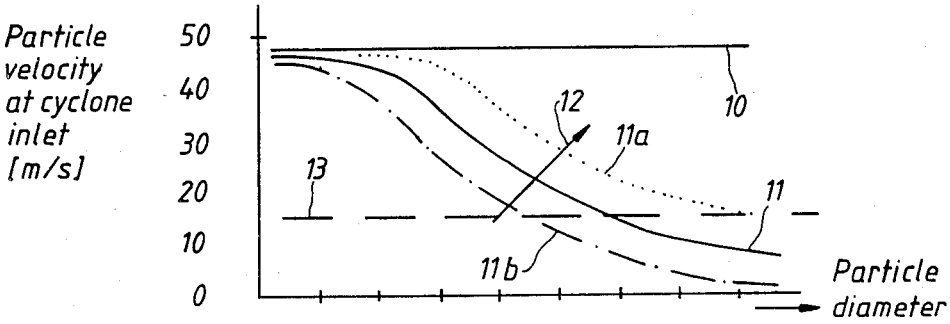
FIG. 3 shows a diagram which explains the effect of the invention.

The effect of the invention is clearly illustrated in FIG. 3. The velocity of the transport gas in the conveying pipe 2 and in the branch pipe is indicated by the line 10. The particle velocity at the cyclone inlet is indicated by the curve 11 which shows a "velocity profile" of the particles. The curve shows that the particle velocity is reduced with increased particle size. The shape and position of the curve 11 are dependent on the length x of the part 5 of the branch pipe as well as on the particle density and shape and gas properties (pressure, temperature, viscosity, etc.). At increased length x, the curve is displaced upwards and to the right, as shown by the arrow 12. The dotted curve 11*a* and chain line curve 11*b*, respectively, show the velocity profile for increased and decreased lengths x, respectively, of the branch pipe part 5. The dashed line 13 represents the normal inlet velocity of gas and particles in a conventional cyclone design. As will be clear from the curve 11, the inlet velocity of the larger particles lies below the line 13, which is desirable from the point of view of erosion and working life of the separator.

Figure 4:
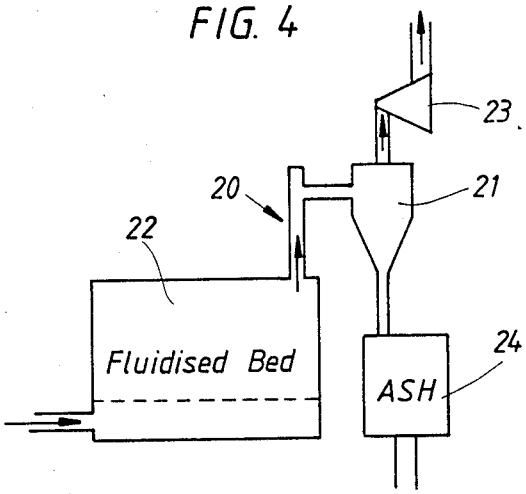
FIG. 4 shows, purely schematically, a PFBC plant to which the invention has been applied.

A cyclone separator according to the invention is most valuable for the separation of bed material or ashes from transport gas in a PFBC plant with a bed equipment and ash discharge equipment shown schematically in FIG. 4. A PFBC plant of this type is shown and described in U.S. patent application Ser. No. 563,427 filed on the 20th Dec. 1983 in the name of Roine Brännström and reference should be made thereto for further details.

The cyclone separator 21 in FIG. 4 is positioned at the outlet end of a gas-retarding/accelerating device 20 which in turn is connected to a source 22 of particle-contaminated gas. Particles separated from the separator 21 can be collected in a container 24 and the purified gas led on to a gas-utilising device 23 such as a gas turbine.

When using the method of the invention it is possible to work with high transportation speeds for gas entering the device 21, for example 50–60 m/s. A direct supply of the gas-particle mixture into the cyclone separator 21 at this high speed would result in an intolerable erosion and a short life of the separator. The invention makes it possible to obtain both a tolerable wear of the separator and a high degree of separation of fine particles from its outlet stream.

The cyclone separator 20, 21 according to the invention can also, with a good result, be used for cleaning the gas leaving a PFBC fluidized bed (e.g. 22) before entering the gas turbine (e.g. 23).

I claim:

1. A method of increasing the separating efficiency without a corresponding increase in the erosion rate of a cyclone separator for removing particles from a gas-particulate mixture, said cyclone separator having an inlet downstream of a means for supplying a gas-particle mixture comprising a flow of gas and a flow of larger and smaller sized particles having substantially the same velocity as said gas, and said substantially the same velocity being sufficient for said large particles to cause erosion of said cyclone separator, said method comprising: retarding said particles in a region between said supply means and the inlet into said cyclone separator so as to decrease the velocity of said particles relative to the velocity of said gas; and accelerating said retarded particles with said gas flow over a transport distance between said retarding region and said cyclone separator inlet, said gas velocity and said transport distance being selected such that said smaller sized particles achieve substantially higher velocities than said larger sized particles at said separator inlet.

2. A method according to claim 1, in which said particle flow is retarded by causing it to undergo a deflection in passing through the said region.

3. A method according to claim 2, in which the deflection of the gas-particle flow is through an angle of substantially 90°.

4. A method according to claim 3, in which the said region includes a T-shaped pipe, one branch of the T-shaped pipe serving as gas inlet, a second branch at right angles thereto serving as gas outlet and a third branch defining a blind space in which a stationary pad of said retarded particles forms, which pad communicates with the point of deflection.

5. A method according to claim 4, in which said one branch and said third branch are collinear.

6. The method of claim 1 in which said gas velocity and said transport distance are selected so as to provide a velocity profile of the velocities of said particles relative to the size of said particles which substantially increases the separating efficiency of said separator for said smaller particles without substantially decreasing the separating efficiency of said separator for said larger particles.

7. A method according to claim 6, in which the velocity of the largest particles at the said inlet is less than 15 m/s while the velocity of the smallest particles entering the said inlet exceeds 50 m/s.

8. A method as claimed in claim 1, when applied to a cyclone separator downstream of a fluidized bed in a pressurized fluidized bed combustion (PFBC) plant.

9. A method as claimed in claim 8, when the cyclone separator forms part of a gas cleaning system between the fluidized bed and a gas turbine of the PFBC plant.

10. The method of claim 1 in which said cyclone separator has a wall adjacent to said separator inlet and said substantially the same velocity is sufficient for said large particles to cause erosion of said separator wall at a significant wear rate, and in which said gas velocity and said transport distance are selected so as to provide a velocity profile of the velocities of said particles relative to the size of said particles which substantially reduces the wear rate of said separator wall.

11. The method of claim 10 in which the largest of said larger particles enters said separator inlet at a velocity which does not exceed 20 m/s while the smallest of said smaller particles enter said separator inlet at a velocity which exceeds 30 m/s.

12. A method as claimed in claim 11, when applied to a cyclone separator downstream of a fluidized bed in a pressurized fluidized bed combustion (PFBC) plant.

13. A method as claimed in claim 12 when the cyclone separator forms part of a gas cleaning system between the fluidized bed and a gas turbine of the PFBC plant.

14. An apparatus for increasing the separating efficiency without a corresponding increase in the erosion rate of a cyclone separator for removing particles from a gas-particle mixture, said cyclone separator having an inlet downstream of a means for supplying a gas-particle mixture comprising a flow of gas and a flow of larger and smaller sized particles having substantially the same velocity as said gas, said apparatus comprising:

means for retarding said particles in a region between said supply means and the inlet into said cyclone separator so as to decrease the velocity of said particles relative to the velocity of said gas; and, transport means attached to and extending between said retarding means and said cyclone separator inlet for accelerating said retarded particles with said gas flow over a transport distance between said retarding means and said cyclone separator inlet, said gas velocity and said transport distance being such that said smaller sized particles achieve substantially higher velocities than said larger sized particles at said separator inlet and providing a velocity profile of the velocities of said particles relative to the size of said particles which substantially increases the separating efficiency of said separator for said smaller particles without substantially decreasing the separating efficiency of said separator for said larger particles.

15. The apparatus of claim 14 in which said retarding means includes means for slowing down substantially to a standstill at least a portion of said larger sized particles.

16. The apparatus of claim 14 in which said retarding means includes a wall defining a blind space for accumulating a cushion of said particles preventing direct contact of said particle flow with said blind space wall.

17. An apparatus according to claim 14, in which said means for supplying comprises a supply pipe, and said supply pipe, said retardation means, and said transport means in combination form a T-shaped branch pipe having a stem and aligned crossarms, said supply pipe comprising one crossarm, said retardation means comprising the other crossarm, and said transport means comprising the stem connected to the inlet of the cyclone.

18. An apparatus according to claim 17, in which the apparatus including the cyclone separator is included in a particle-separating discharge system in a PFBC plant for separating particles from a transport gas leaving the bed.

19. An apparatus according to claim 17, in which the apparatus including the cyclone separator is used in a combustion gas cleaning system downstream of a fluidized bed.

20. An apparatus according to claim 17, in which the apparatus including the cyclone separator is included in a gas cleaning system between a fluidized bed and a gas turbine in a PFBC plant.

* * * * *